United States Patent [19]

Samuels et al.

[11] Patent Number: 4,521,184

[45] Date of Patent: Jun. 4, 1985

[54] PRESSURE FIXING DEVICE

[75] Inventors: Abe Samuels, Chicago, Ill.; Keitaro Yamashita, Saitama; Yoshitaka Sasaki, Kumagaya, both of Japan

[73] Assignees: Hitachi Metals, Ltd., Japan; Speed-O-Print Business Machines Corp., Chicago, Ill.

[21] Appl. No.: 541,350

[22] Filed: Oct. 12, 1983

[51] Int. Cl.[3] ..... G03G 15/00; F27B 9/28

[52] U.S. Cl. ..... 432/60; 432/75; 355/3 FU; 29/132

[58] Field of Search ..... 432/59, 8, 60, 75, 228; 355/3 FU; 29/132

[56] References Cited

U.S. PATENT DOCUMENTS

| | | | |
|---|---|---|---|
| 3,811,821 | 5/1974 | Ariyama et al. | 432/60 |
| 3,880,577 | 4/1975 | Tomono et al. | 432/60 |
| 3,941,558 | 3/1976 | Takiguchi | 432/75 |
| 3,942,230 | 3/1976 | Nalband | 432/60 |
| 3,951,585 | 4/1976 | Fujimoto | 432/60 |
| 3,964,431 | 6/1976 | Namiki | 432/60 |
| 4,192,229 | 3/1980 | Tsunoi et al. | 100/158 R |
| 4,200,389 | 4/1980 | Matsui et al. | 355/3 FU |
| 4,258,095 | 3/1981 | Larson et al. | 428/172 |
| 4,259,920 | 4/1981 | Sasaki | 118/116 |
| 4,324,482 | 4/1982 | Szlucha | 432/75 |
| 4,343,234 | 8/1982 | Sasaki | 100/158 R |

*Primary Examiner*—Henry C. Yuen

*Attorney, Agent, or Firm*—Finnegan, Henderson, Farabow, Garrett & Dunner

[57] ABSTRACT

A pressure fixing device including a pair of pressure rolls formed of metal which are maintained in pressing contact with each other and allow a support member supporting thereon a toner image to pass therebetween. At least the pressure roll coming into contact with the toner image has a coarse surface having a surface coarseness of over 1.9 μm (Ra). A cleaning felt member may be provided which is adapted to come into contact with the pressure roll not coming into contact with the toner image, and a heat generating member may be arranged around the pressure roll coming into contact with the toner image, to thereby heat the pressure roll to a temperature below 80° C.

3 Claims, 2 Drawing Figures

PRESSURE FIXING DEVICE

BACKGROUND OF THE INVENTION (1) Field of the Invention

This invention relates to fixing devices, and more particularly it is concerned with a pressure fixing device comprising a pair of pressure rollers allowing a support member supporting a toner image to pass therebetween to effect fixing of the toner image to the support member.

(2) Description of the Prior Art

In image forming apparatus comprising electrophotographic copying apparatus, facsimile systems, printers and the like, a pressure fixing device comprising at least one pair of pressure rolls is commonly used as one of the devices for obtaining fixing of a powder toner image (hereinafter toner image) formed on a support member, such as a sheet of paper, by developing or transfer-printing.

The pressure fixing devices are broadly classified into a 2 roll type shown in FIG. 1 of U.S. Pat. No. 4,192,229, for example, and a 3 roll type described in U.S. Pat. Nos. 4,259,920 and 4,343,234, for example. In ordinary pressure fixing devices, the pressure rolls are subjected to the following treatment to avoid an offset phenomenon. The pressure rolls are provided by subjecting rolls formed of steel to heat treatment to obtain hardening of the material, applying hard chromium plating to the surfaces of the rolls and subjecting the rolls to grinding to provide their surfaces with a coarseness of below 0.8 S ($\approx$0.2 $\mu$mRa). This gives a smooth and lustrous surface to the image fixed by the pressure rolls obtained by the aforesaid process. However, because of the glare caused by the lustrous surface, the image may be hard to see depending on the angle at which the viewer looks at the sheet carrying the image fixed by the pressure rolls.

Proposals have been made, in order to obviate the aforesaid disadvantage of the prior art and provide an image fixed by pressure rolls which is free from a shiny surface, to treat the surface of the metal roll that comes into contact with a toner image by means of a sand blast to form irregularities on the surface and then apply hard chrominum plating to the surface to provide a coarse surface with rounded, minuscule elevations and depressions (1.3 S–5.0 S), as described in U.S. Pat. No. 4,200,389. U.S. Pat. No. 4,258,095 described a pressure fixing device comprising pressure rolls that have a surface coming into contact with a toner image treated as with silicon carbide to give a coarseness of 0.2–1.2 $\mu$m(Ra) thereto.

The pressure rolls of the prior art having coarse surfaces as described hereinabove still have the problem that, because their surface coarseness is 1.2 $\mu$m(Ra) at best in view of obtaining excellent results in fixing images while avoiding the occurrence of an offset phenomenon, the luster of a fixed image is not sufficiently reduced to enable the viewer to clearly recognize the image as compared with an image that is thermally fixed. Moreover the pressure fixing devices of the prior art have had the problem that no satisfactory results are achieved in avoiding the occurrence of an offset phenomenon.

SUMMARY OF THE INVENTION (1) Object

This invention has been developed for the purpose of obviating the aforesaid disadvantages of the prior art.

Accordingly the invention has as its object the provision of a pressure fixing device capable of greatly reducing the luster of an image fixed by the device.

(2) Statement of the Invention

The outstanding characteristic of the invention is that, in a pressure fixing device comprising a pair of pressure rolls of metal in pressure contact with each other to allow a support member for supporting a toner image to pass therebetween, at least one of pressure rolls coming into contact with the toner image having its surface coarsened, the surface of the at least one of the pressure rolls has a surface coarseness of over 1.9 $\mu$m(Ra).

DETAILED DESCRIPTION OF THE PREFERRED EMBODIMENT

The invention will now be described in detail by referring to a preferred embodiment shown in the accompanying drawings.

Figure 1:
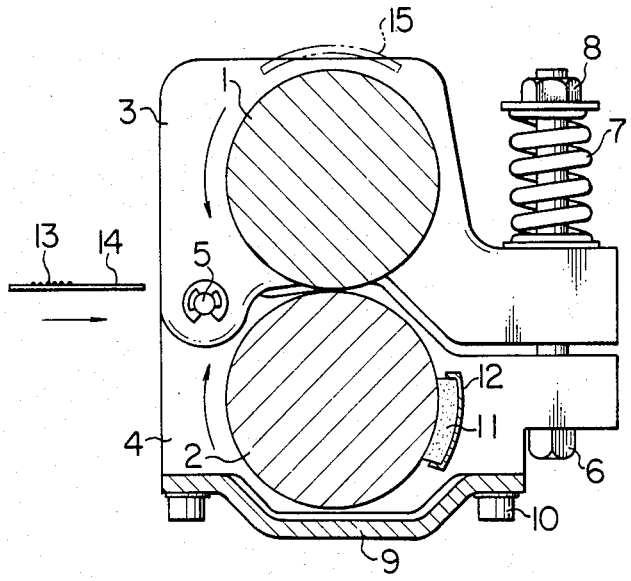
FIG. 1 is a sectional view of the pressure fixing device comprising one embodiment of the invention.

Referring to FIG. 1, a fixing roll 1 and a pressure applying roll 2, both formed of steel, are rotatably supported on side plates 3 and 4, respectively, that form a pair. The side plates 3 and 4 are connected to each other for rotation by a pin 5 at one end thereof and have a pressure applying bolt 6 applied thereto at the other end thereof. The pressure applying bolt 6 has a compression coil spring 7 mounted thereon and adapted to be pressed by a pressure applying nut 8 threadably connected thereto. The side plate 4 is detachably attached through a bolt 10 to a base plate 9 which is removably mounted on a copying apparatus main body, not shown. A cleaning felt member 11 supported on a holder 12 secured to the side plate 4 is arranged around the pressure applying roll 2 in such a manner that the surface of the felt member 11 is in contact with the surface of the pressure applying roll 2.

Figure 2:
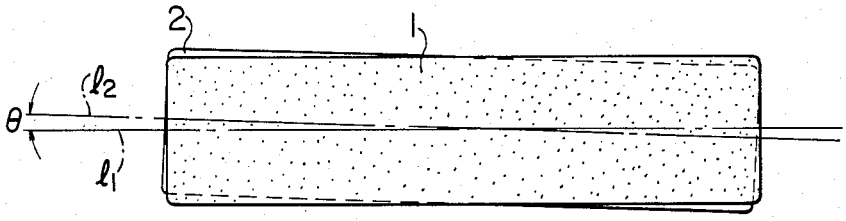
FIG. 2 is a plan view of the fixing roll and the pressure applying roll shown in FIG. 1.

In the aforesaid construction, when the pressure applying nut 8 is adjusted, the compression coil spring 7 can be deformed by compression to thereby press the pressure applying roll 2 against the fixing roll 1. When the fixing roll 1 and the pressure applying roll 2 are in this condition, an image fixed by pressure can be obtained if the fixing roll 1 is rotated, for example, by drive means, not shown, and a copy sheet 14 supporting a toner image thereon is passed between the two rolls 1 and 2. In this case, a high pressure in the range between 15 and 40 kg/cm$^2$ is usually applied between the rolls 1 and 2, so that the axis $l_1$ of the fixing roll 1 and the axis $l_2$ of the pressure applying roll 2 cross each other at a minuscule angle $\theta$ as shown in FIG. 2 to obtain a substantially uniform pressure distribution in an axial direction. Usually the angle $\theta$ is set in the range between 1 and 2 degrees.

Like ordinary rolls, the pressure applying roll 2 is provided by quench hardening a roll of steel and applying hard chrominum plating to its surface. However, the fixing roll 1 has its surface coarsened. A coarsened surface is obtained by treating the surface of a quench hardening roll of steel with a sand blast using pointed, hard particulate material, such as silicon carbide particles, and then applying hard chrominum plating to its surface. In this case, it is necessary that the surface coarseness be over 1.9 μm(Ra) to enable an essentially lusterless image to be obtained as is the case with an image fixed thermally. If, however, the surface coarseness is too high, transfer of the pressure to toner particles (usually of 5–50 μm in particle size) on the copy sheet does not take place satisfactorily and an excellent result is not obtained in effecting fixing. Thus the surface coarseness is preferably 3.0 μm(Ra) at a maximum.

When the surface of the fixing roll 1 is coarsened, the invention is not limited to the aforesaid process of surface coarsening. Alternatively hard chromium plating may be first applied to the surface of a quench hardening roll of steel and then the plated surface may be subjected to sand blast treatment. When the sand blast treatment is carried out, pointed, hard particulate material may be used and additionally steel balls may also be used. No matter what material is used, it is necessary that the surface coarsenseess of the roll be over 1.9 μm(Ra).

No problem is raised for all intents and purposes if the hard chromium plating has a thickness of over 5 μm.

The particulate material used to carry out sand blast treatment may be selected from the group consisting of silicon carbide, aluminum oxide and emery. No matter what material is used, the particulate material preferably has a particle size of 30–60 mesh to obtain the aforesaid surface coarseness.

As described hereinabove, the higher the coarseness of the roll surface, the lower is the effect achieved in fixing an image. To avoid a reduction in the effect achieved in fixing an image, a heat generating member 15 (indicated by dash-and-dot lines) may be arranged in such a manner that it covers a portion of the fixing roll 1 as shown in FIG. 1. However, if the surface temperature of the roll is too high, the temperature of bearings rises which is not desirable. Thus it is necessary that the surface temperature of the roll be below 80° C.

In pressure fixing devices of the prior art, it has hitherto been usual practice to apply an offset preventing liquid (which is usually silicon oil) to the surface of a roll to avoid the occurrence of an offset phenomenon and then to bring a cleaning felt member into contact with the surface of the fixing roll with pressure of a certain extent being applied thereto. However, no satisfactory result has been obtained by the aforesaid means in preventing the occurrence of an offset phenomenon. A study of the problem by us has revealed that satisfactory results can be obtained by bringing a cleaning felt member into pressing contact with the surface of the roll that is not brought into contact with the toner image or the pressure applying roll when image fixing is carried out.

The surface coarseness referred to in this specification is based on JIS (Japanese Industrial Standards) B 0601-1976.

EXAMPLE

In FIGS. 1 and 2, steel rolls of 50 mm in outer diameter and 270 mm in length were used as the fixing roll 1 and the pressure applying roll 2. The pressure applying roll 2 was subjected to grinding to have a surface coarseness of 0.8 μm(Ra) after having hard chromium plating of 10 μm in thickness applied thereto. Specimens of the fixing roll 1 having seven different surface conditions ranging from No. 1 to No. 7 as shown in Table 1 were prepared. Silicon carbide was used in performing sand blast treatment, and the specimens Nos. 2 and 3 were first subjected to sand blast treatment with silicon carbide particles and then subjected to blast treatment with steel balls. All the specimens or specimens No. 1 to No. 7 each had a chrome plating thickness in the range between 12 and 18 μm.

TABLE 1

| Roll Specimen No. | Surface Treatment | Surface Coarseness μm (Ra) |
|---|---|---|
| 1 | Mirror surface finish following chromium plating | 0.11 |
| 2 | Blast treatment following chromium plating | 0.12 |
| 3 | Blast treatment following chromium plating | 1.0 |
| 4 | Chromium plating following blast treatment | 1.9 |
| 5 | Chromium plating following blast treatment | 2.2 |
| 6 | Chromium plating following blast treatment | 2.7 |
| 7 | Chromium plating following blast treatment | 3.2 |

A cleaning felt member was adapted to come into contact with the pressure roll not coming into contact with said toner image.

Fixing tests were conducted using specimens No. 1 to No. 7 of the fixing roll shown in Table 1. The cross angel $\theta$ of the rolls was 1′ 40″ and the pressure acting between the rolls was adjusted to 20 kg/cm$^2$ (in the central portion of the rolls). The rolls were rotated at a peripheral velocity of 100 mm/sec to carry out fixing of an image by using ZnO paper of a thickness in the range between 80 and 90 μm for 100 sheets for each specimen of the fixing roll. The results of the tests are shown in Table 2. The toner used was magnetic toner of the pressure fixing type (HMT 615 made by Hitachi Metal Company Limited). Silicon oil (KF 96 made by Shinetsu Chemical Company Limited) was applied to the surface of the fixing roll for preventing the occurrence of an offset phenomenon.

TABLE 2

| Roll Specimen No. | Luster | Fixing Rate (%) | Offset |
|---|---|---|---|
| 1 | 45 | 66 | o |
| 2 | 20 | 64 | Δ |
| 3 | 4 | 53 | Δ |
| 4 | 6 | 51 | o |
| 5 | 5 | 49 | o |
| 6 | 4 | 47 | o |
| 7 | 3 | 40 | o |

Notes:
o Excellent
ΔGood
x Poor

In Table 2, the luster of the specimens was measured by means of a glossimeter made by Gardner Laboratory, Inc., and the fixing rate is represented by image concentration/fixed image concentration (×100) obtained by rubbing the image surface following fixing with a finger. The presence or absence of the offset phenomenon was determined with the naked eye.

As can be clearly seen in Table 2, specimens Nos. 4–7 of coarse surface rolls according to the invention yielded fixed images having the luster greatly reduced as compared with images fixed using specimen No. 1 of mirror surface finish roll, so that images obtained by fixing have substantially the same degree of luster as the degree of luster (about 3–5) of images fixed thermally. It is clear that as compared with the degree of luster yielded by specimens Nos. 2 and 3 of coarse surface rolls of the prior art, the specimens Nos. 4–7 of coarse surface rolls according to the invention provide images with the degree of luster equivalent or reduced. Images fixed using specimens No. 7 of roll are satisfactory in the degree of luster but low in the fixing rate which is not desirable.

Fixing tests were conducted by using specimens Nos. 6 and 7 of the roll for 50,000 sheets supporting images. The results obtained show that the surface coarseness was over 1.6 μm(Ra) in all the test sheets and it has be ascertained that the fixed images are all reduced in the degree of luster.

We claim:

1. A pressure fixing device comprising:

a pair of pressure rolls formed of metal maintained in pressing contact with each other and allowing a support member supporting thereon a toner image to pass therebetween, wherein at least the pressure roll coming into contact with said toner image of said pair of pressure rolls has a surface coarseness in the range 1.9 μm(Ra) to about 2.7 μm(Ra), the device further comprising cleaning means adapted to come into contact with the pressure roll not coming into contact with said toner image, and means for heating the pressure roll coming into contact with said toner image to a temperature below 80° C.

2. The pressure fixing device as in claim 1, wherein said cleaning means includes an arcuately shaped felt cleaning member.

3. The pressure fixing device as in claim 1 wherein said heating means includes an arcuately shaped heating member.

* * * * *